US009797584B2

(12) United States Patent
Andretta-Pulera

(10) Patent No.: US 9,797,584 B2
(45) Date of Patent: Oct. 24, 2017

(54) DECORATIVE LIGHTING DISPLAYING SYSTEM

(71) Applicant: Francesca Andretta-Pulera, Delray Beach, FL (US)

(72) Inventor: Francesca Andretta-Pulera, Delray Beach, FL (US)

( * ) Notice: Subject to any disclaimer, the term of this patent is extended or adjusted under 35 U.S.C. 154(b) by 59 days.

(21) Appl. No.: 14/923,540

(22) Filed: Oct. 27, 2015

(65) Prior Publication Data

US 2017/0114988 A1 Apr. 27, 2017

(51) Int. Cl.

| | |
|---|---|
| ***F21V 21/08*** | (2006.01) |
| ***F21S 4/26*** | (2016.01) |
| ***F21V 21/088*** | (2006.01) |
| *F21W 121/00* | (2006.01) |
| *F21Y 115/10* | (2016.01) |

(52) U.S. Cl.

CPC ..... *F21V 21/08* (2013.01); *F21S 4/26* (2016.01); *F21V 21/088* (2013.01); *F21W 2121/00* (2013.01); *F21Y 2115/10* (2016.08)

(58) Field of Classification Search

CPC ..... F21V 21/10; F21V 21/08; F21V 21/088; F21Y 2101/02; F21Y 2115/10; F21W 4/10; F21W 2121/00; F21W 2121/002; F21W 2121/004; F21W 2121/006; F21W 2121/008; F21W 2121/02; F21W 2121/04; F21W 2121/06; F21S 4/20; F21S 4/26; F21S 4/22

USPC ..... 362/219.16

See application file for complete search history.

(56) References Cited

U.S. PATENT DOCUMENTS

| | | | | |
|---|---|---|---|---|
| 4,462,065 | A | 7/1984 | Rhodes | |
| D365,982 | S | 1/1996 | Bologna et al. | |
| 6,779,906 | B1 | 8/2004 | Delmar | |
| 8,469,322 | B1 * | 6/2013 | Oxley | F21V 21/00 248/237 |
| 8,485,690 | B1 | 7/2013 | Garcia et al. | |
| 8,960,616 | B2 * | 2/2015 | Gibbons | F16M 13/022 248/200 |
| 2003/0066938 | A1 * | 4/2003 | Zimmerman | F21V 21/088 248/301 |
| 2006/0120089 | A1 * | 6/2006 | Liberatore | F21V 21/08 362/391 |
| 2007/0008724 | A1 * | 1/2007 | Raska | F21S 4/20 362/249.16 |
| 2007/0041189 | A1 * | 2/2007 | Mchinnis | F21S 4/10 362/249.16 |

* cited by examiner

*Primary Examiner* — Robert May

(57) ABSTRACT

A decorative lighting displaying system for arranging a light cord into a plurality of coils on a stanchion includes a stanchion that extends upwardly from a support surface. A mount is positioned on the stanchion. The mount is vertically oriented on the stanchion. A light cord is wrapped around the stanchion. The mount engages the light cord such that the light cord is retained on the stanchion.

3 Claims, 4 Drawing Sheets

DECORATIVE LIGHTING DISPLAYING SYSTEM

BACKGROUND OF THE DISCLOSURE

Field of the Disclosure

The disclosure relates to lighting devices and more particularly pertains to a new lighting device for arranging a light cord into a plurality of coils on a stanchion.

SUMMARY OF THE DISCLOSURE

An embodiment of the disclosure meets the needs presented above by generally comprising a stanchion that extends upwardly from a support surface. A mount is positioned on the stanchion. The mount is vertically oriented on the stanchion. A light cord is wrapped around the stanchion. The mount engages the light cord such that the light cord is retained on the stanchion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
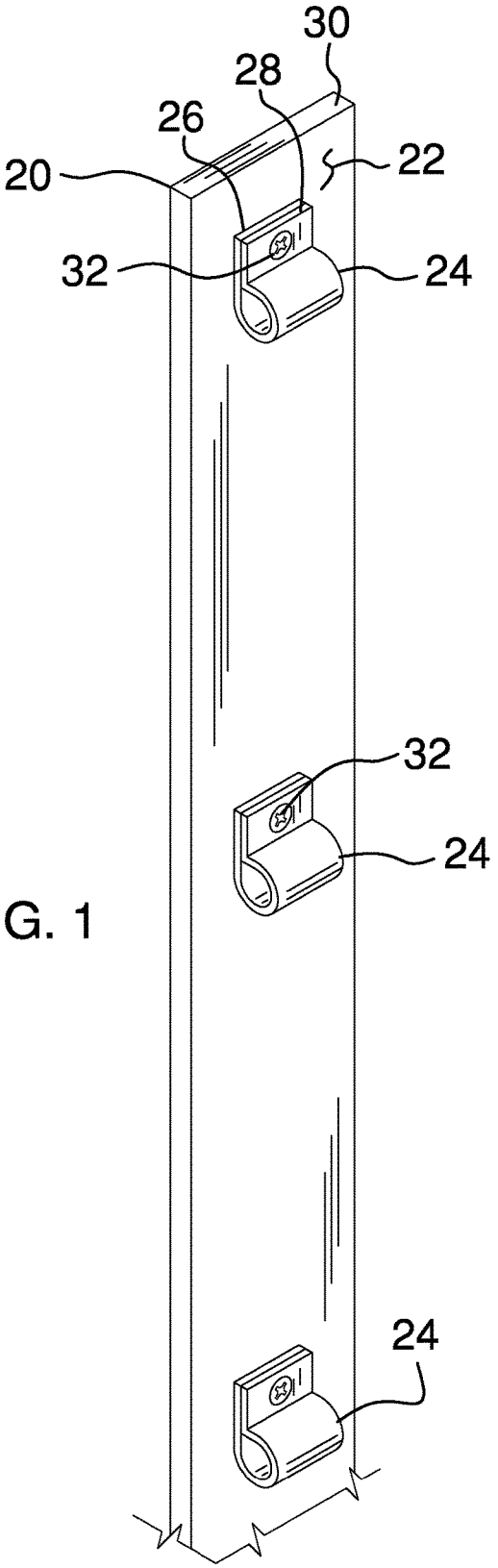
FIG. 1 is a perspective view of a decorative lighting system according to an embodiment of the disclosure.
Figure 2:
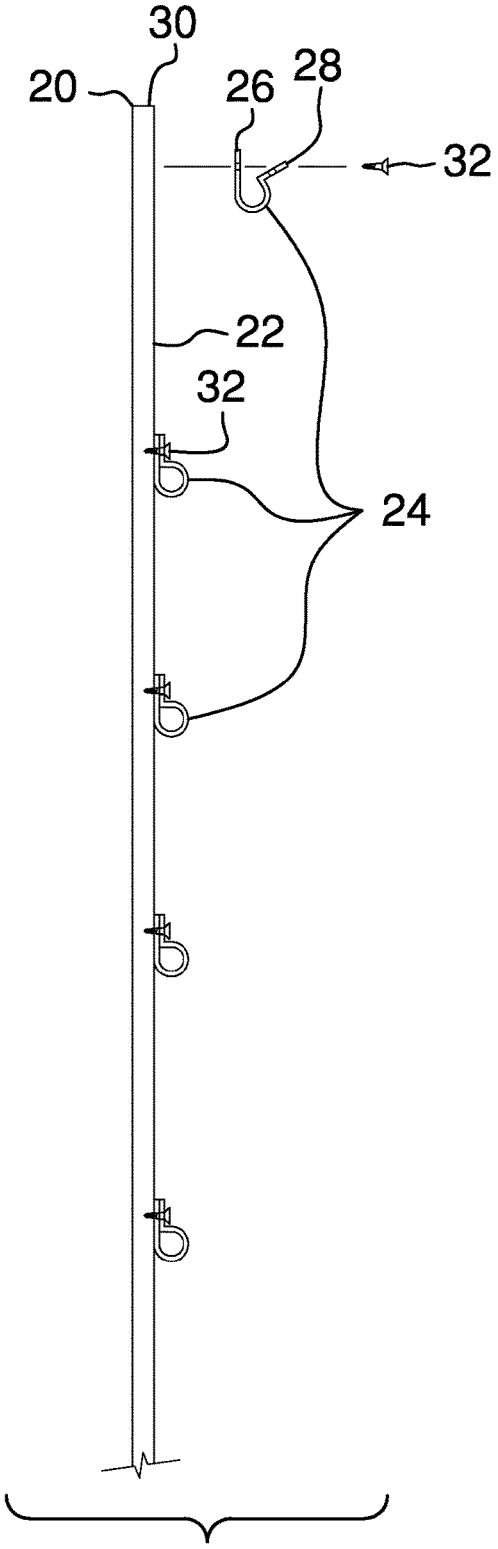
FIG. 2 is a right side view of an embodiment of the disclosure.
Figure 3:
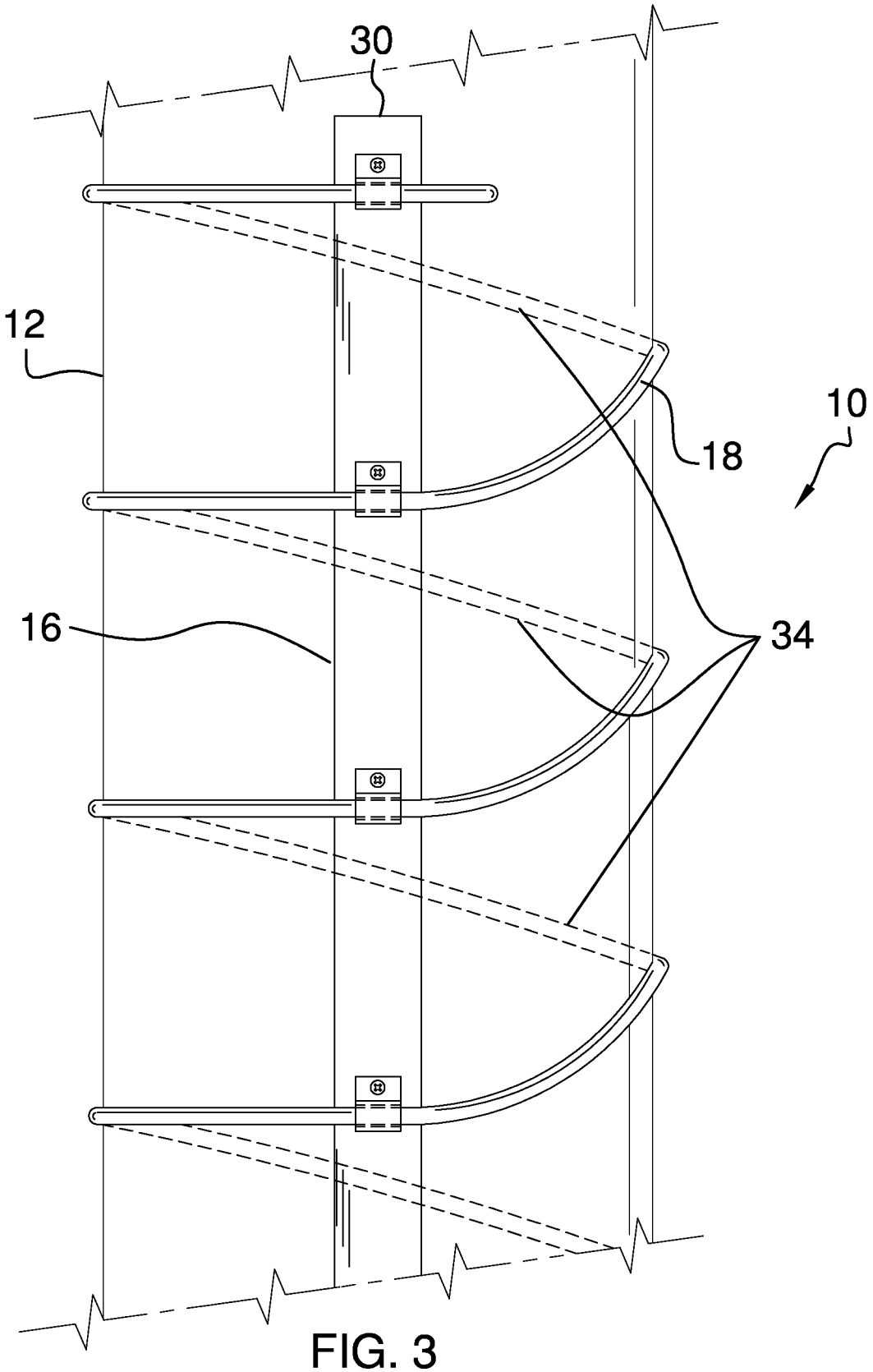
FIG. 3 is a front phantom view of an embodiment of the disclosure.

With reference now to the drawings, and in particular to FIGS. 1 through 5 thereof, a new lighting device embodying the principles and concepts of an embodiment of the disclosure and generally designated by the reference numeral 10 will be described.

As best illustrated in FIGS. 1 through 5, the decorative lighting system 10 generally comprises a stanchion 12 extending upwardly from a support surface 14. The stanchion 12 may comprise a tree or the like and the support surface 14 may comprise ground. A mount 16 is positioned on the stanchion 12 and the mount 16 is vertically oriented on the stanchion 12. A light cord 18 is wrapped around the stanchion 12. The mount 16 engages the light cord 18 such that the light cord 18 is retained on the stanchion 12.

The mount 16 comprises a board 20 that has a first surface 22. A plurality of clips 24 is provided and each of the clips 24 has a first end 26 and a second end 28. Each of the clips 24 is curved such the first end 26 of an associated one of the clips 24 is aligned with the second end 28 of the associated clip 24. Thus, each of the clips 24 forms an open loop.

Each of the clips 24 is fastened to the first surface 22. The clips 24 are spaced apart from each other and are distributed along the board 20. Each of the clips 24 is oriented such that the first end 26 and the second end 28 of each of the clips 24 are directed toward a longitudinal end 30 of the board 20. The board 20 may have a length ranging between approximately sixty cm and one hundred twenty cm.

A plurality of fasteners 32 is provided. Each of the fasteners 32 extends through an associated one of the clips 24 and engages the board 20. Thus, each of the clips 24 is retained on the board 20. Each of the fasteners 32 may comprise a screw or the like. The light cord 18 is manipulated to extend through each of the clips 24 such that the light cord 18 forms a plurality of coils 34 extending around the stanchion 12. Each of the coils 34 is spaced apart from each other and is distributed along the stanchion 12. The light cord 18 may comprise an LED light cord, Christmas tree lights or other electrical decorative light cord.

Figure 4:
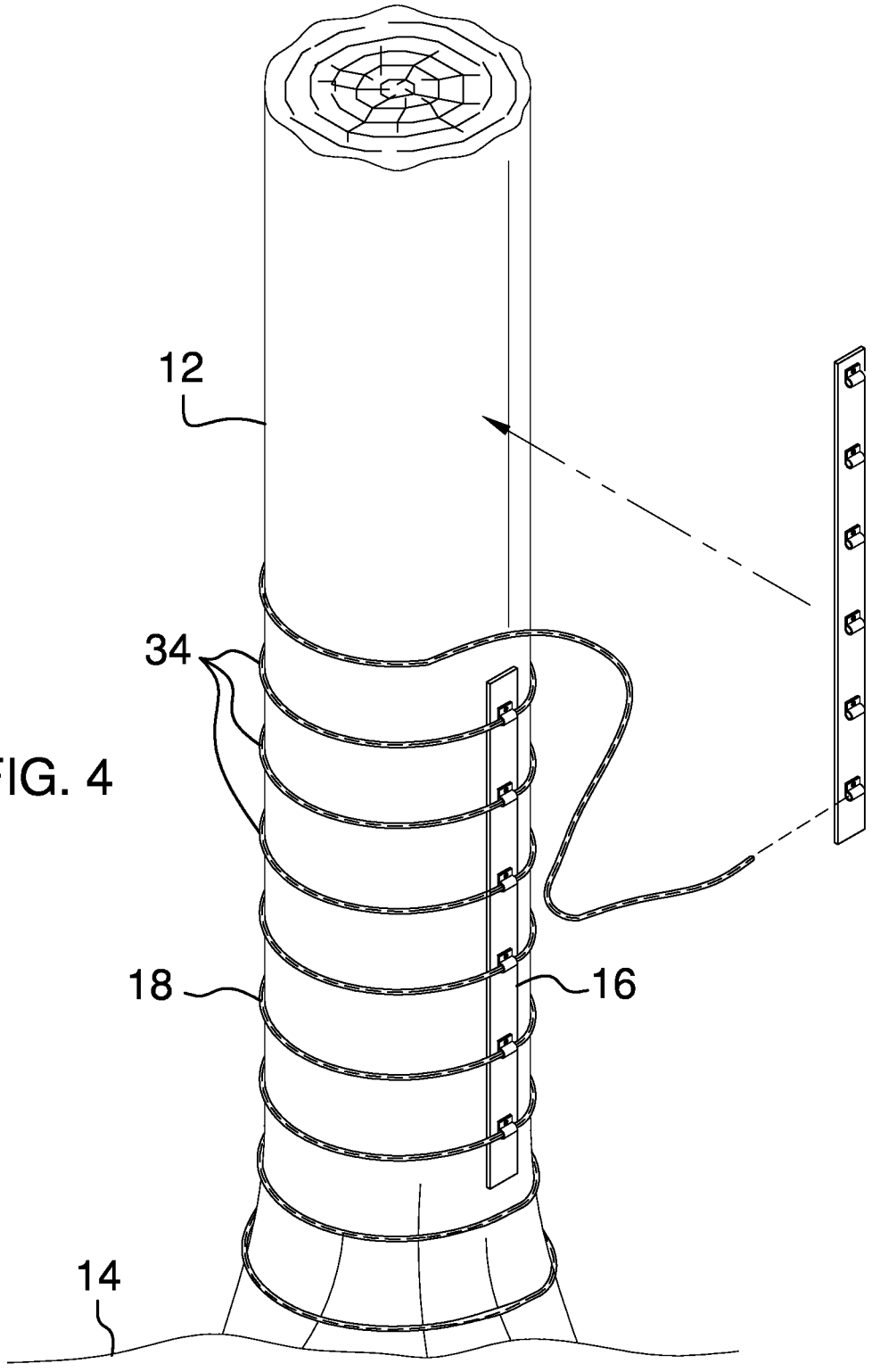
FIG. 4 is a perspective in-use view of an alternative embodiment of the disclosure.
Figure 5:
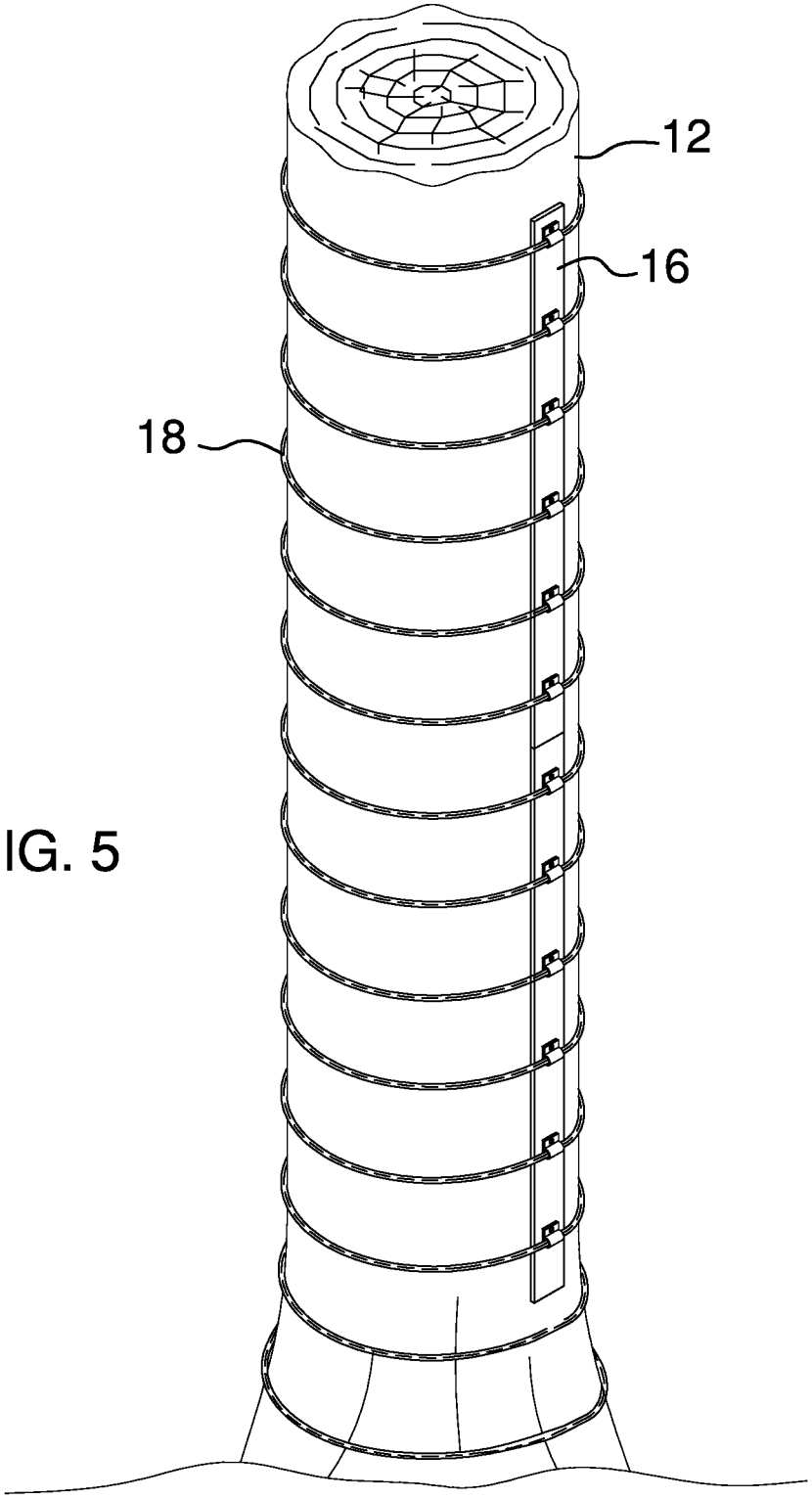
FIG. 5 is a front perspective view of an alternative embodiment of the disclosure.

In use, the mount 16 is positioned against the stanchion 12. The light cord 18 is wrapped around the stanchion 12 and the light cord 18 is extended through the clips 24. The clips 24 keep the coils 34 spaced apart from each other. The mount 16 inhibits the light cord 18 from slipping downwardly along the stanchion 12. In an alternative embodiment as shown in FIGS. 4 and 5, a plurality of the mounts 20 may be stacked on top of each other on the stanchion 12. The light cord 18 is extended through the clips 24 on each of the mounts 20.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A decorative lighting displaying system comprising:

a stanchion extending upwardly from a support surface;

a mount being positioned on said stanchion, said mount being vertically oriented on said stanchion, said mount comprising a board having a first surface, a plurality of clips, each of said clips being coupled to said board, each of said clips having a first end and a second end, each of said clips being curved such said first end of an associated one of said clips is aligned with said second end of said associated clip having each of said clips forming an open loop, and a plurality of fasteners, each of said fasteners being extendable through both said first end and said second end of an associated one of said clips and engaging said board such that each of said clips is secured into a closed loop retained on said board; and a light cord being extendable through said closed loops when said light cord is wrapped around said stanchion, said mount engaging said light cord such that said light cord is retained on said stanchion.

2. The system according to claim 1, wherein, each of said clips being fastened to said first surface, each of said clips being oriented such that said first end and said second end of each of said clips is directed toward a longitudinal end of said board.

3. A decorative lighting displaying system comprising:

a stanchion extending upwardly from a support surface;

a mount being positioned on said stanchion, said mount being vertically oriented on said stanchion, said mount comprising:

a board having a first surface, a plurality of clips, each of said clips having a first end and a second end, each of said clips being curved such said first end of an associated one of said clips is aligned with said second end of said associated clip having each of said clips forming an open loop, each of said clips being fastened to said first surface, said clips being spaced apart from each other and distributed along said board, each of said clips being oriented such that said first end and said second end of each of said clips is directed toward a longitudinal end of said board, and a plurality of fasteners, each of said fasteners being extendable through both said first end and said second end of an associated one of said clips and engaging said board such that each of said clips is secured into a closed loop retained on said board; and a light cord being extendable through said closed loops when said light cord is wrapped around said stanchion, said mount engaging said light cord such that said light cord is retained on said stanchion, said light cord extending through each of said clips such that said light cord forms a plurality of coils extending around said stanchion, each of said coils being spaced apart from each other and being distributed along said stanchion.

* * * * *